US010823522B2

(12) United States Patent
Lee

(10) Patent No.: US 10,823,522 B2
(45) **Date of Patent: *Nov. 3, 2020**

(54) FIREARM SUPPRESSOR ADAPTER

(71) Applicant: Darryl S. Lee, Fort Myers, FL (US)

(72) Inventor: Darryl S. Lee, Fort Myers, FL (US)

(73) Assignee: NSSIP LLC, Fort Myers, FL (US)

( * ) Notice: Subject to any disclaimer, the term of this patent is extended or adjusted under 35 U.S.C. 154(b) by 185 days.

This patent is subject to a terminal disclaimer.

(21) Appl. No.: 15/790,319

(22) Filed: Oct. 23, 2017

(65) Prior Publication Data

US 2018/0335268 A1 Nov. 22, 2018

Related U.S. Application Data

(63) Continuation of application No. 15/601,528, filed on May 22, 2017, now Pat. No. 9,891,017.

(51) Int. Cl.
*F41A 21/32* (2006.01)

(52) U.S. Cl.
CPC ..... *F41A 21/325* (2013.01)

(58) Field of Classification Search
CPC ..... F41A 21/325; F41A 21/32; F41A 21/34; F41A 21/36; F41A 21/38; F41A 21/40
USPC ..... 89/14.2, 14.3, 14.4, 14.5
See application file for complete search history.

(56) References Cited

U.S. PATENT DOCUMENTS 2,351,037 A * 6/1944 Green ..... F41A 21/34 89/14.5
2,866,288 A * 12/1958 Herter ..... F41A 21/42 42/79
3,535,809 A * 10/1970 Oswald ..... F41A 21/16 102/355
3,710,679 A * 1/1973 Werbell, III ..... F41A 21/30 89/14.4
4,510,843 A * 4/1985 Rabatin ..... F41A 21/325 89/14.4
5,509,345 A * 4/1996 Cyktich ..... F41A 21/325 42/97
5,652,406 A * 7/1997 Phan ..... F41A 21/36 89/14.3
5,773,746 A * 6/1998 Vaden ..... F41A 21/325 181/223
7,735,406 B1 * 6/2010 Olson ..... F41A 21/325 89/14.3
8,490,535 B1 * 7/2013 Moore ..... F41A 21/30 181/223
8,516,941 B1 * 8/2013 Oliver ..... F41A 21/30 181/223
8,997,621 B1 * 4/2015 Dater ..... F41A 21/325 89/14.3

(Continued)

*Primary Examiner* — Joshua E Freeman

(74) *Attorney, Agent, or Firm* — Nicholas Pfeifer; Smith & Hopen, P. A.

(57) ABSTRACT

A fast-attaching, self-aligning, easily adaptable and preferably tool-less suppressor adapter. The novel adapter attaches to the barrel of a firearm while precisely aligning the barrel and adapter using a set of compression feet equidistantly spaced around the perimeter of the adapter. The device is adapted to attach to a wide range of barrel diameters via an easy to fit and inexpensive to manufacture fitment sleeve. Thus, the adapter can be manufactured in a single size and work with most firearms. In addition, the device attaches to the smooth section of barrel thereby eliminating the need for permanently modifying a firearm by threading the barrel.

20 Claims, 15 Drawing Sheets

(56) References Cited

U.S. PATENT DOCUMENTS 9,182,187 B1* 11/2015 Griffith ..... F41A 21/325
9,658,019 B2* 5/2017 Smith ..... F41A 21/325
2001/0049996 A1* 12/2001 Fluhr ..... F41A 21/30 89/14.4
2003/0019351 A1* 1/2003 Fluhr ..... F41A 21/30 89/14.4
2003/0019352 A1* 1/2003 Mika ..... F41A 21/36 89/14.05
2005/0188829 A1* 9/2005 Hanslick ..... F41A 21/38 89/14.3
2007/0017358 A1* 1/2007 Ho ..... F41A 17/44 89/30
2007/0095198 A1* 5/2007 Dater ..... F41A 21/325 89/14.2
2008/0098880 A1* 5/2008 Brugger ..... F41A 21/30 89/14.4
2008/0156183 A1* 7/2008 Brittingham ..... F41A 21/30 89/14.4
2010/0275492 A1* 11/2010 Moller ..... F41A 21/325 42/79
2011/0154711 A1* 6/2011 Dickerson ..... F41A 21/325 42/107
2012/0103176 A1* 5/2012 Latka ..... F41A 21/30 89/14.4
2012/0180623 A1* 7/2012 Graham, II ..... F41A 21/325 89/14.4
2013/0180797 A1* 7/2013 Dueck ..... F41A 21/30 181/223
2015/0253098 A1* 9/2015 Russell ..... F41A 21/325 89/14.4
2015/0323275 A1* 11/2015 Lessard ..... F41A 21/34 89/14.4
2016/0061551 A1* 3/2016 Petersen ..... F41A 21/30 89/14.4
2016/0102935 A1* 4/2016 Young ..... F41A 21/325 42/76.01
2016/0209152 A1* 7/2016 Dueck ..... B23K 26/282
2017/0167816 A1* 6/2017 Young ..... F41A 21/325

* cited by examiner

FIREARM SUPPRESSOR ADAPTER

CROSS-REFERENCE TO RELATED APPLICATIONS

This nonprovisional application is a continuation of and claims priority to nonprovisional application Ser. No. 15/601,528, entitled "FIREARM SUPPRESSOR ADAPTER," filed May 22, 2017 by the same inventor.

BACKGROUND OF THE INVENTION

1. Field of the Invention

This invention relates, generally, to firearms suppressors. More specifically, it relates to a universal adapter for firearm suppressors.

2. Brief Description of the Prior Art

Most gunfire produce sound that exceeds 140 dB, which can cause immediate and irreparable hearing loss to the gun operate and also significantly contributes to sound pollution. The effects of gun-fire noise are evidenced by the prevalence of hearing damage among veterans, law enforcement, and older individuals that have been around unsuppressed gun-fire. Fortunately, firearm suppressors or "silencers" can reduce the gun-fire noise to a safe hearing range below 140 dB.

The primary functions of a suppressor are to trap, intercept, contain, disrupt, slow and/or redirect the expanding gas of the muzzle blast of a firearm. This allows the gas to slow and dissipate prior to exiting the muzzle of the suppressor. When gas is allowed, or forced to slow and cool, the report of the gunshot is lowered to a non-damaging level. The longer the gas stays in the suppressor, the more the heat dissipates, and in turn, less sound in produced.

Up to now, despite the obvious health and societal benefits of suppressor use, a suppressor could not easily be fitted to most firearms without using inflexible, narrowly sized, mostly unavailable, and possibly damaging adapters; or without having the gun barrel cut and machined by a gunsmith on a lathe.

There are a few current methods for attaching a suppressor to a non-threaded barrel of a firearm. Among other problems, these methods can be time consuming, imprecise, and damaging to the gun. Most importantly, however, they are inflexible and only work with a very narrow range of firearms with a similar barrel diameter, barrel geometry, and location of barrel protrusions.

The most common method for attaching a suppressor to a non-threaded barrel firearm, is to hire a gunsmith to machine threads onto the barrel. Unfortunately, this process permanently alters the firearm. Many gun enthusiasts are unwilling to alter the factory dynamics of their firearm. It will never be original after this process, which can negatively affect the value of some guns. This process can also be costly and time consuming. For example, the process typically includes:

1. Finding a gunsmith that cuts barrel threads, which is often difficult because the gunsmith profession is a dying trade. There are also new government regulations requiring gunsmiths to register with ITAR and pay a $2,250 tax. The gunsmith profession is a low profit business for many and this new regulation, if not repealed, will cause some to drop out of the profession.
2. The next step includes a federally licensed dealer logging the gun into his/her acquisitions and dispositions book. There are many gun enthusiasts that become dissuaded from using gunsmiths because of this gun logging step.
3. Next, the gunsmith has to disassemble the gun and then use a lathe to precisely carve threads into the barrel at a specific size and tolerance. This is important because the threads can be cut in 7 or 8 different configuration. The gun is only able to mount a suppressor having the exact thread size and thread turn that corresponds to the threads cut into the barrel. In addition, a gunsmith only has one opportunity to correctly thread the barrel. The changes are permanent and cannot be fixed.
4. Finally, the gunsmith must reassemble the gun and then the gunsmith or federally licensed dealer must log the gun out of their acquisitions and dispositions book.
5. In addition, had the gun owner needed to send the barrel to an out of town gunsmith, the gun owner must perform the extra steps of disassembling the gun, finding the proper means for mailing the barrel, and reassembling the gun when the barrel is returned.

Alternatively, a suppressor can be secured to a gun using of one of the existing adapter systems listed below:

1. A set screw system manufactured to a certain diameter for a particular firearm. This system is intended to slide onto the end of the muzzle and tightened thereto using set screws. Unfortunately, these adapters require specific tools to tighten the set screws and said set screws can damage the barrel when tightened. Moreover, this system is not consistently centered to the muzzle due to the fluctuations in barrel size. This size difference in barrels can be found even within the same gun model from one year to the next. Furthermore, barrel diameter is measured in hundredths or thousandths of an inch. To manufacture and stock an adapter that can fit every barrel from 0.5 to 1 inch, even if only measuring to the hundredths, would take 50 different sizes. Finally, this method is not recommended for tapered barrels, which are prevalent in most long guns. When you add other geometrical differences like tapered verses straight barrels, barrels with iron sights verses unobstructed barrels, and barrels with and without shrouds, there are thousands of different barrel types requiring thousands of versions of this adapter. The manufacturing cost, packaging cost and inventory cost is prohibitive, which is why the set screw-style adapter is typically only manufactured for a few barrels.
2. A bolt-on an adapter manufactured for an exact barrel size. This adapter style is manufactured for straight barrels or barrels with obstructions. This method is not recommended for tapered barrels. The adapters are usually manufactured for specific gun models due to the expense of machining and inventorying all the different sizes required to fit other models. This adapter requires tools and time to install. When you consider other geometrical differences like barrels with iron sights and barrels with shrouds, it is clear that this style of an adapter is a custom adapter incapable of attaching to a variety of gun barrels.
3. A very limited suppressor adapter is designed to mount to a barrel nut on an AR platform gun. The barrel nut adapter fits one barrel and only one style of gun. Like the other options, this system requires tools and time to install.
4. Another option is attaching an adapter to the iron sights at the end of a barrel. This is not a recommended method to install anything on a gun, let alone, a suppressor that has a large amount of longitudinal force pulling against the sight when the gun is fired. The iron sight must be a certain distance from the muzzle of the gun due to the specific groove length cut into the adapter for fitment to the iron sight. To install this adapter on a different gun, the iron sights would have to have the same measurement from the muzzle to the rear of sight and the same barrel diameter. Like the other methods, each version of this adapter is made for a particular gun and lacks the ability to fit different gun models.

5. Finally, there is a method of attaching the adapter to a groove or grooves in the flash hider of an AR style platform gun with a certain size and style flash hider at the end of the barrel. This adapter is only usable for one style of gun where the distance between the muzzle and the groove on the flash hider is the same. The lack of variability occurs because the engagement of the adapter fins into the flash hider groove is achieved at a set distance from the muzzle. The length between the muzzle and the grove is not adjustable and, therefore, this style adapter it is not adaptable to other guns.

All of these methods have drawbacks and problems that prevent the respective adapters from being widely adopted. Accordingly, what is needed is a firearm adapter that can overcome all the problems listed above, is easy-to-use, and can quickly, accurately, securely, and concentrically attach a suppressor or suppressor extension to the barrel of a firearm. However, in view of the art considered as a whole at the time the present invention was made, it was not obvious to those of ordinary skill in the field of this invention how the shortcomings of the prior art could be overcome.

While certain aspects of conventional technologies have been discussed to facilitate disclosure of the invention, Applicant in no way disclaims these technical aspects, and it is contemplated that the claimed invention may encompass one or more of the conventional technical aspects discussed herein.

The present invention may address one or more of the problems and deficiencies of the prior art discussed above. However, it is contemplated that the invention may prove useful in addressing other problems and deficiencies in a number of technical areas. Therefore, the claimed invention should not necessarily be construed as limited to addressing any of the particular problems or deficiencies discussed herein.

In this specification, where a document, act or item of knowledge is referred to or discussed, this reference or discussion is not an admission that the document, act or item of knowledge or any combination thereof was at the priority date, publicly available, known to the public, part of common general knowledge, or otherwise constitutes prior art under the applicable statutory provisions; or is known to be relevant to an attempt to solve any problem with which this specification is concerned.

BRIEF SUMMARY OF THE INVENTION

The long-standing but heretofore unfulfilled need for an easy-to-use, adapter that can quickly, accurately, securely, and concentrically attach a suppressor or suppressor extension to the barrel of a variety of firearms is now met by a new, useful, and nonobvious invention.

In an embodiment, the novel structure includes a first sheath having a longitudinal axis that houses a chassis, a drive collar, and two or more compression feet. The chassis includes a hollow interior sized to receive a barrel of the firearm and is axially aligned with the longitudinal axis of the first sheath. The chassis further includes a plurality of slots disposed therein. Each slot is sized to receive and house one of the compression feet.

The drive collar includes a central bore aligned with the longitudinal axis which provides a space to receive the barrel of the firearm. Moreover, the drive collar has two or more feet receipts with each of the feet receipts adapted to receive one of the compression feet. In addition, a drive pin is secured within each of the feet receipts and extends perpendicular to a longitudinal axis of the drive collar.

The compression feet each have a first end, a second end, and a length extending therebetween with the length generally aligned with the longitudinal axis of the drive collar. The compression feet are further defined by an outer surface, an inner surface, and a width extending therebetween. The width is greater than the distance between the chassis and the drive collar resulting in each of the compression feet residing within one of the plurality of slots in the chassis.

Each compression foot further includes a drive slot having a sloped orientation with respect to the length and width, such that a first end of the drive slot is proximate the first end and inner surface of the drive collar while the second end of the drive slot is proximate the second end and outer surface of the drive collar. Moreover, the length of each of the compression feet is generally the same length as the slots in the chassis, thereby generally preventing the compression feet from substantially moving in a linear direction along the longitudinal axis of the first sheath. Furthermore, each of the drive pins in the drive collar are secured within the drive slot of one of the compression feet. As a result, linear translation of the drive collar along the longitudinal axis of the first sheath forces the drive slots of the compression feet to adjust to the location of the drive pin causing the compression feet to translate in an axial direction—perpendicular to the longitudinal axis of the first sheath.

An embodiment includes threads on an internal surface of the first sheath. The threads on the first sheath interconnect with threads on an outer surface of the drive collar. The first sheath is adapted to rotate about the longitudinal axis of the first sheath, while the drive collar is rotationally fixed about the longitudinal axis of the first sheath. As a result, rotation of the first sheath about the longitudinal axis of the first sheath cause linear translation of the drive collar in a direction parallel to the longitudinal axis of the first sheath.

In an embodiment, the adapter includes a second sheath having threads on an internal surface. The threads on the second sheath interconnect with threads on an outer surface of a second drive collar housed within the second sheath. The second sheath is adapted to rotate about the longitudinal axis of the second sheath, while the second drive collar is rotationally fixed about the longitudinal axis of the second sheath. Thus, rotation of the second sheath about the longitudinal axis of the second sheath cause linear translation of the second drive collar in a direction parallel to the longitudinal axis of the second sheath.

An embodiment further includes the threads on the first sheath having a thread direction that is opposite the thread direction for the threads on the second sheath. Thus, rotation of the first sheath in a first direction and rotation of the second sheath in a second direction causes the first and second drive collars to travel in the same direction.

In an embodiment, the adapter has a force transferring collar at a distal end of the adapter in mechanical communication with the first sheath. The force transferring collar includes an externally threaded suppressor attachment extending outwardly from the distal end of the adapter in a distal direction. Therefore, a suppressor can threadedly engage the suppressor attachment. Alternatively, the force transferring collar or the first sheath will include internal threads that can mate with a suppressor having an externally threaded attachment.

An embodiment may include a bore alignment device. The bore alignment device has an inner ring with an exit bore offset from a central longitudinal axis of the inner ring. The bore alignment device also includes an outer ring having an inner ring receipt that is offset from a central longitudinal axis of the outer ring. The inner ring receipt is adapted to house at least a portion of the inner ring and the inner and outer rings are rotatable with respect to each other, such that the exit bore can be rotated into a plurality of different locations by rotating both the inner and outer rings.

An embodiment includes a cam lever having cam pins extending inwardly from free ends of the cam lever. The cam pins each have a length and a width with the length being greater than the width. A pair of cam slots are disposed within the first sheath with each cam slot configured to receive one of the cam pins. Each cam slot includes a length extending in a direction parallel to the longitudinal axis of the first sheath and a width extending in a direction perpendicular to the width. A pair of cam pin receipts are disposed in the drive collar with each cam pin receipts configured to receive one of the cam pins. The width of each cam slot is less than the length of the cam pins and the cam lever is rotatable with respect to the first sheath such that rotation of the cam lever to a first position allows the cam pins to travel along the length of the cam slot. In contrast, rotation of the cam lever to a second position causes the cam pins to jam in the cam slot and locks the drive collar and compression feet in place.

An embodiment includes an end cap at a proximal end of the adapter and a force transferring collar at a distal end of the collar. The end cap and the force transferring collar have threaded receipts for the attachment of accessories to the adapter.

An embodiment includes the compression feet each having shoes on an inner surface. The shoes are comprised of compressible material and are curved in shape to mate with the barrel of a firearm when the compression feet contact the barrel.

An embodiment includes a flexible fitment sleeve having an incomplete tubular shape resulting in an adjustable diameter and/or providing a path for iron sights. The fitment sleeve may be relied upon for effectively increasing the barrel diameter to allow a single adapter to work with any barrel diameter. The fitment sleeve may have a tapered design to account for tapered barrels.

An embodiment includes a suppressor attachment extending from the second sheath in an axial direction away from the first sheath and in concentric alignment with the adapter. The suppressor attachment has external threads on which a suppressor can be secured. Alternatively, the second sheath may be axially integrated into a suppressor or suppressor extension.

An object of the invention is to provide a suppressor adapter configured to fit most firearms on the market.

An object of the invention is to provide a tool-less, easy-to-use, adapter that can quickly, accurately, securely, and concentrically attach a suppressor, suppressor extension, or rail attachment to the barrel of a firearm.

It is another object of the invention to provide a suppressor adapter that is far less costly to manufacture due to a one size fits all system, and to eliminate the need to manufacture hundreds of sizes and configurations.

In addition, it is an object of this invention to provide an adapter, which can be secured to or integrated with a suppressor and/or a suppressor extension; and provide an adapter that can attach to one or multiple firearm accessories, including, but not limited to a bipod, an iron sight, a sling mount, a rail for mounting accessories, a hand guard for installation from barrel heat, a forward grip, a flashlight, and a laser.

These and other important objects, advantages, and features of the invention will become clear as this disclosure proceeds.

The invention accordingly comprises the features of construction, combination of elements, and arrangement of parts that will be exemplified in the disclosure set forth hereinafter and the scope of the invention will be indicated in the claims.

BRIEF DESCRIPTION OF THE DRAWINGS

For a fuller understanding of the invention, reference should be made to the following detailed description, taken in connection with the accompanying drawings, in which.

DETAILED DESCRIPTION OF THE INVENTION

In the following detailed description of the present invention, reference is made to the accompanying drawings, which form a part thereof, and within which are shown by way of illustration specific embodiments by which the invention may be practiced. It is to be understood that other embodiments may be utilized and structural changes may be made without departing from the scope of the invention.

The present invention is a firearm adapter configured to fit most gun barrel. The adapter preferably attaches to the smooth section of a barrel and doesn't require any tooling or permanent modification to the barrel for securement of the adapter to a firearm. The ability of the present invention to attach to a variety of gun barrels reduces the costs associated with manufacturing, packaging, labeling, and stocking because a single adapter of the present invention can replace thousands of different suppressor and rail adapters.

Figure 1:
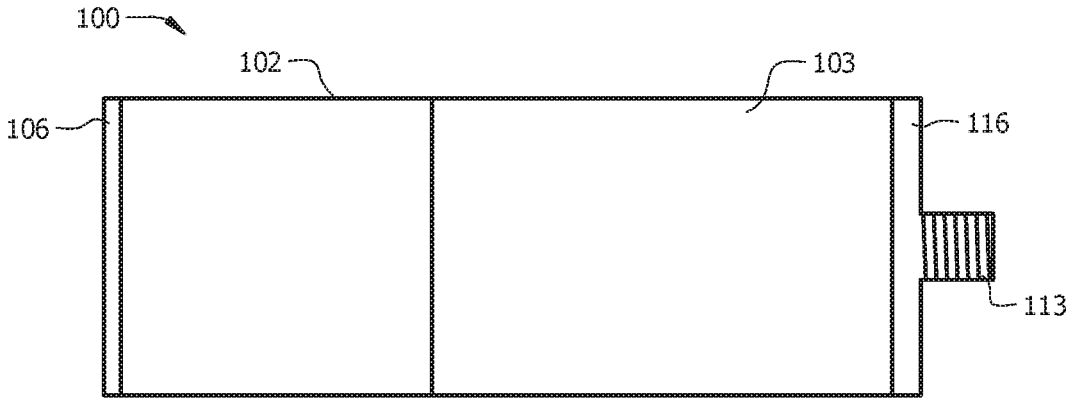
FIG. 1 is an elevation view of an embodiment of the present invention.
Figure 2:
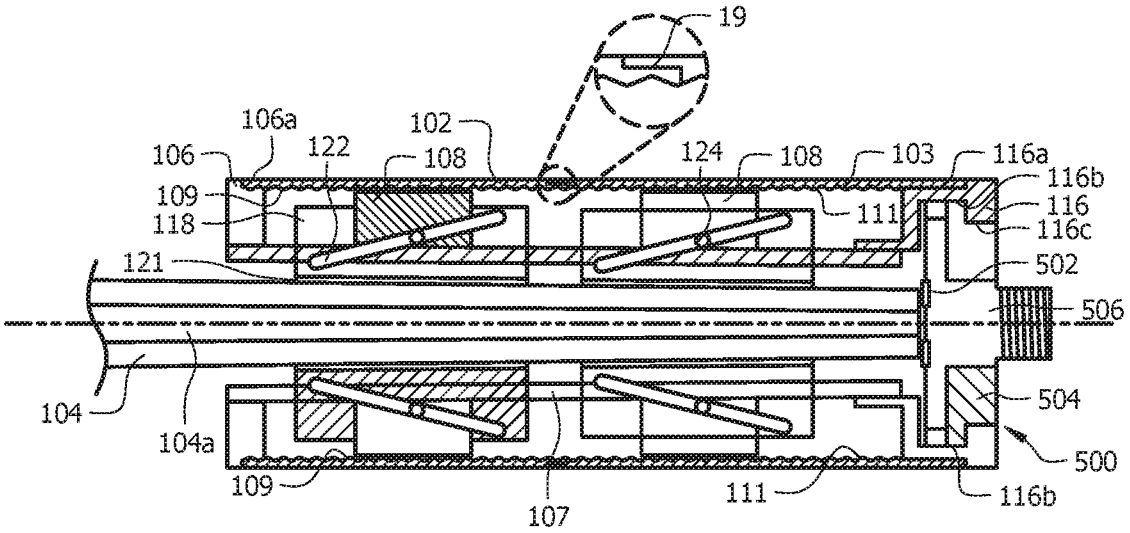
FIG. 2 is a sectional elevation view of an embodiment of the present invention highlighting the internal mechanisms of the adapter.

Referring now to FIGS. 1-2, an embodiment of firearm adapter 100 includes first sheath 102 in rotatable communication with second sheath 103. The adapter and its sheaths 102, 103 are preferably cylindrical in shape, but may have any shape that allows the adapter to be secured to the barrel of a firearm.

First and second sheaths 102, 103 are secured between proximal end cap 106 and force transfer collar 116 located at the distal end of adapter 100. Both the proximal end cap 106 and the force transferring collar 116 include a generally centrally located aperture to respectively receive the barrel 104 and bore alignment device 500.

Proximal end cap 106 includes a seat 106*a*, which provides a structural point about which sheath 102 rotates. Likewise, force transferring collar 116 includes seat 116*a*, about which the distal end of sheath 103 can rotate. Seats 106*a* and 116*a* may include friction reducing mechanisms and/or fluids, including, but not limited to bearings and/or grease to allow the sheaths to easily rotate about the longitudinal axis of adapter 100.

The distal end of sheath 102 and the proximal end of sheath 103 are in rotatable communication, which can be achieved via the overlapping, stepped connection 119 depicted in FIG. 2. The interconnection points at the distal and proximal ends of sheaths 102, 103 may include friction reducing mechanisms and/or fluids, including, but not limited to bearings and/or grease to allow the sheaths to easily rotate about the longitudinal axis of adapter 100.

Figure 3:
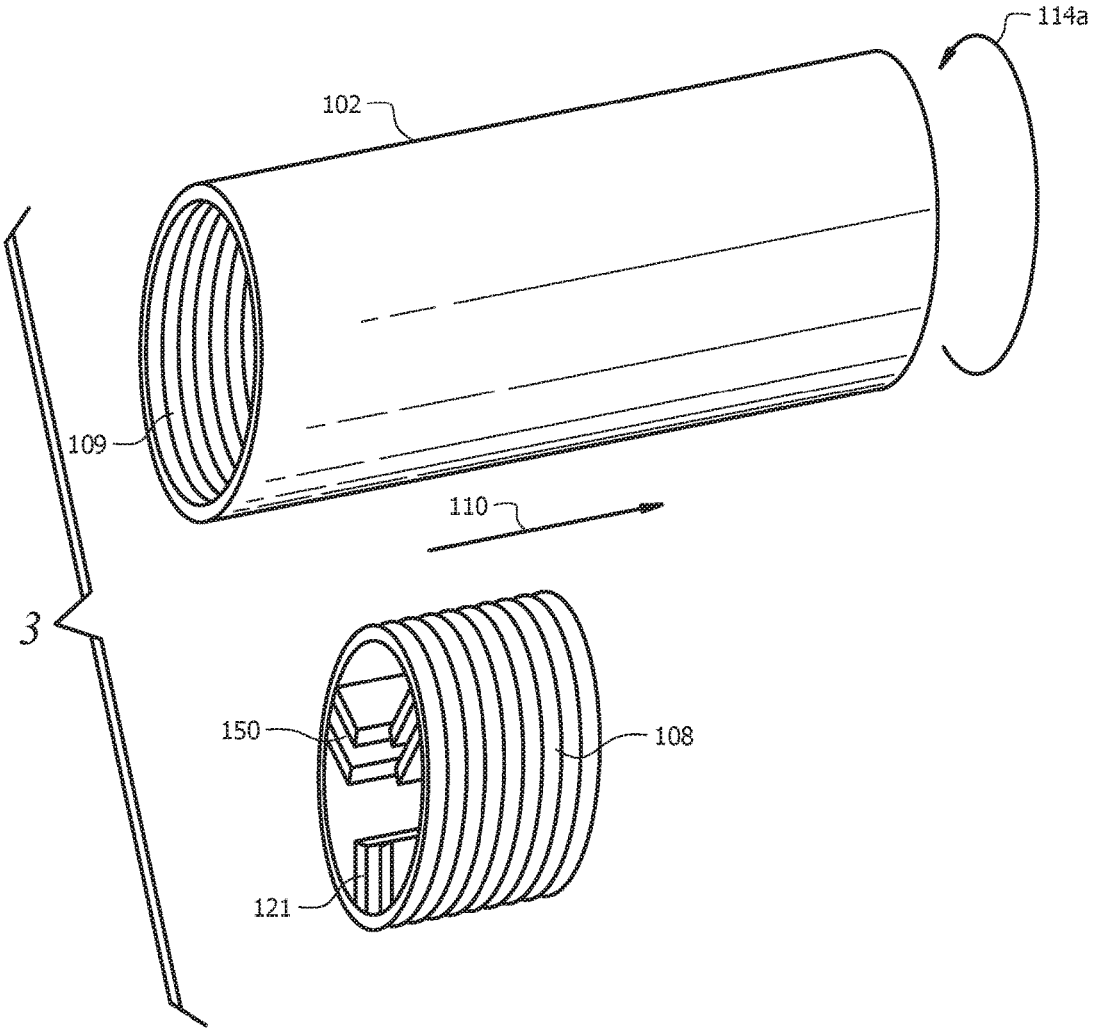
FIG. 3 is an exploded view of an embodiment of the present invention showing an outer rotatable sheath and a drive collar.

Referring now to FIGS. 2-3, sheaths 102 and 103 further include threaded internal surfaces 109, 111, respectively. Internal surface 109 includes threads having an opposite rotational direction with respect to the threads on internal surface 111. As a result, clockwise rotation of sheath 102 equates to counter-clockwise rotation of sheath 103, and vice versa.

Sheaths 102, 103 include one or more drive collars 108, which threadedly engage internal surfaces 109, 111 of sheaths 102, 103. Thus, the opposite rotation of sheaths 102, 103, as depicted by rotational arrows 114*a*, 114*b* in FIGS. 3 and 6, will cause drive collars 108 to translate in a linear direction in accordance with arrow 110. The mechanics of converting the rotational movement of sheaths 102, 103 into the linear movement of drive collars 108 will be explained in subsequent paragraphs.

Figure 4:
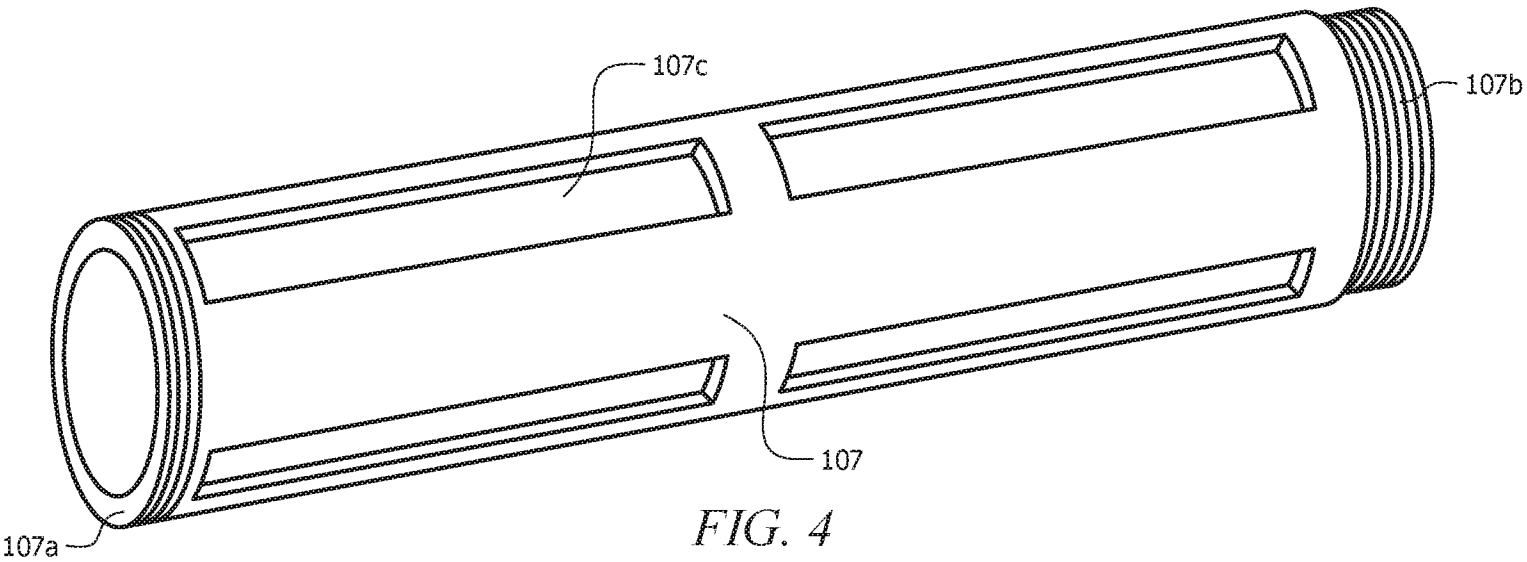
FIG. 4 is a perspective view of an embodiment of the chassis.

Referring to FIGS. 2 and 4, adapter 100 further includes a preferably cylindrical chassis 107 secured to and extending between end cap 106 and force transferring collar 116. As depicted in FIG. 4, an embodiment of chassis 107 includes threads at proximal end 107*a* to engage end cap 106 and threads at distal end 107*b* to engage force transferring collar 116. Chassis 107, however, may interconnect with end cap 106 and force transferring collar 116 through any fastening method known to a person of ordinary skill in the art. It is preferred that distal end 107*b* includes a temporary attachment to force transferring collar 116 to allow the force transferring collar 116 to be disconnected in case a new bore alignment device 500 needs to be secured to adapter 100.

Figure 5:
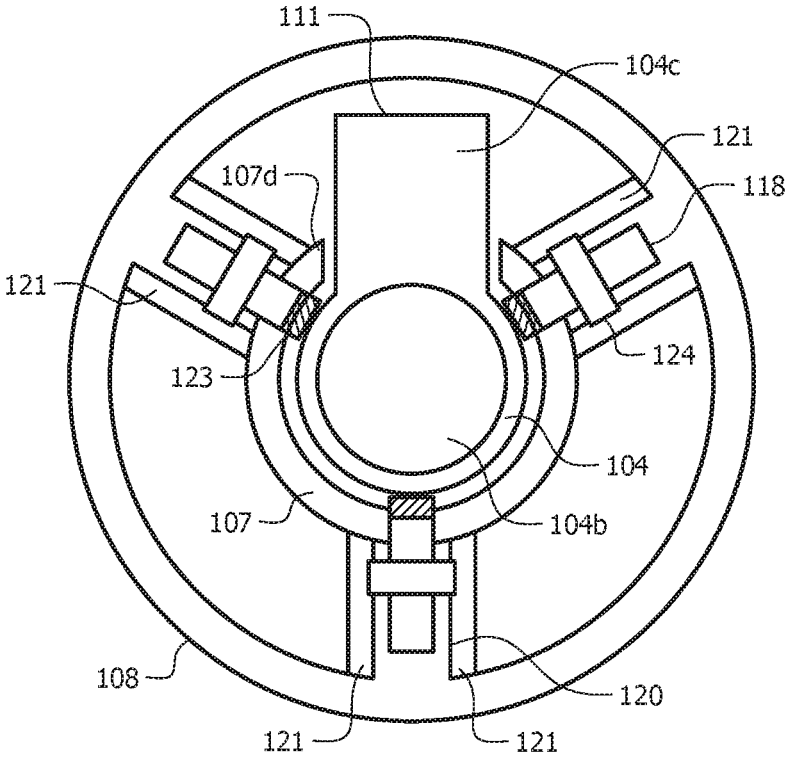
FIG. 5 is a cross-sectional view of an embodiment of the drive collar, chassis, and compression feet encircling a firearm barrel.

Chassis 107 may provide a structural support about which drive collars 108 can translate, but preferably includes a plurality of retaining slots 107*c* sized to receive compression feet 118. Chassis 107 preferably includes one slot corresponding to each compression foot. Moreover, as depicted in FIG. 5, an embodiment of chassis 107 includes a sight gap 107*d* which aligns with sight slot 113 disposed in end cap 106, and force transferring collar 116. Sight gap 107*d* and sight slot 113 allow a gun barrel with iron sights 104*c* to easily slide into adapter 100.

Referring now to FIGS. 2-6, two or more compression feet are arranged around barrel 104 at a preferably equidistantly spaced relation about the perimeter of drive collar 108. Drive collar 108 includes feet receipts 150 established preferably by inwardly projecting structural members 121. Feet receipts 150 radially align with retaining slots 107*c* in chassis 107 and compression feet 118 are secured within both feet receipts 150 and retaining slots 107*c*. Because compression feet 118 reside within stationary chassis 107, compression feet 118 prevent drive collar 108 from rotating when one of sheaths 102, 103 is rotated. As a result, the threaded connection between sheaths 102, 103 and drive collars 108 forces drive collars 108 in a linear direction, as depicted by arrows 110, when sheaths 102, 103 are rotated in accordance with arrows 114*a*, 114*b*. The direction of travel is based on the direction of the threads and the direction in which the sheaths are rotated.

Moreover, drive pins 124 are secured between structural members 121 in drive collar 108 and pass through sloped drive slot 122 in compression feet 118. As depicted best in FIG. 7, each compression foot 118 has a drive slot 122 that starts near internal surface 118*c* at first end 118*a* and slopes towards outer surface 118*d* at second end 118*b* of compression foot 118. Furthermore, compression feet 118 are preferably sized to have generally the same length as retaining slots 107*c* to prevent compression feet 118 from traveling in a linear direction when drive collar 108 is forced in a linear direction. Therefore, as drive collar 108, and in turn drive pin 124, travel in a linear direction, each compression foot 118 in connection with drive collar 108 will be forced in a radial direction in accordance with the slope of drive slot 122.

Figure 6:
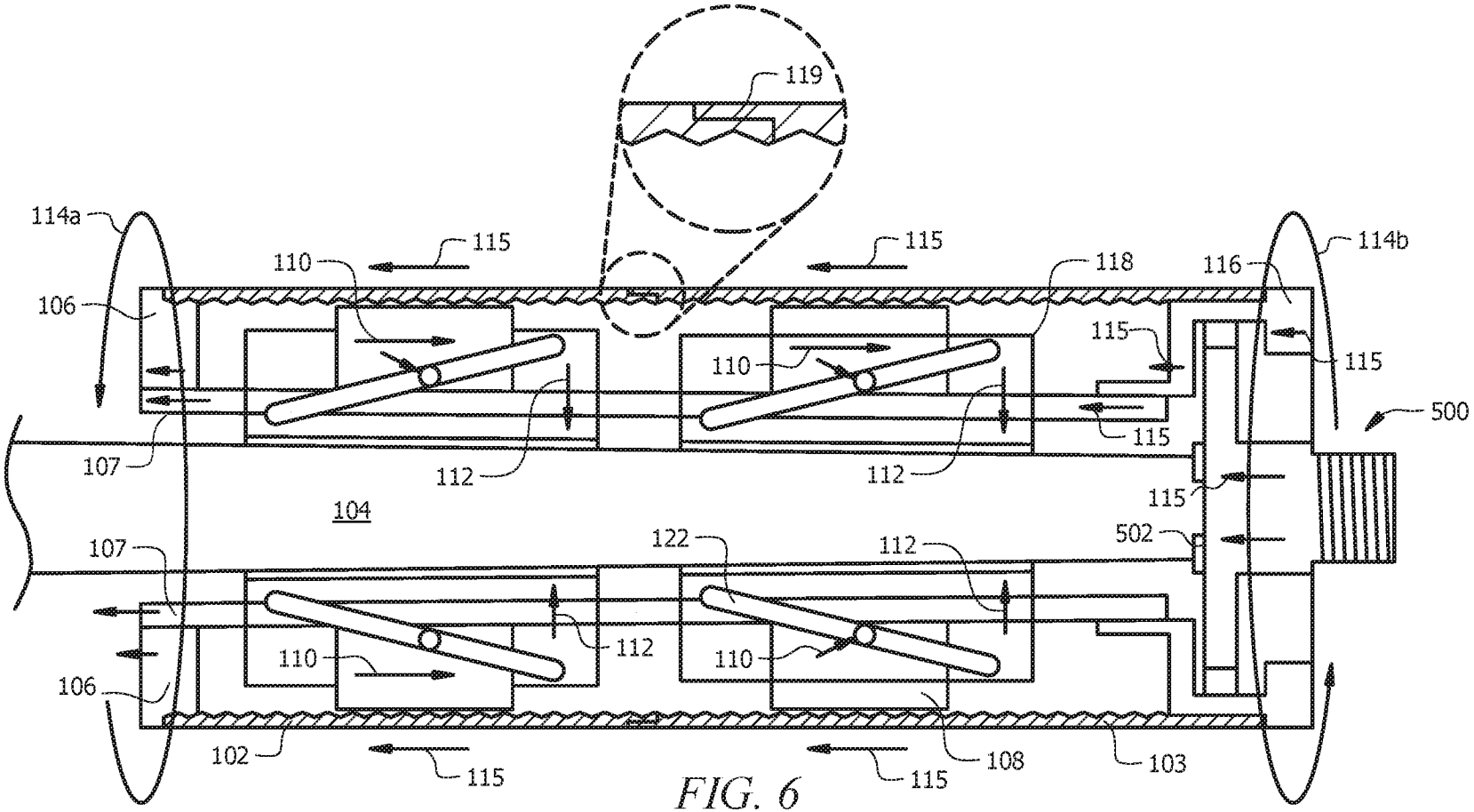
FIG. 6 is a sectional elevation view of an embodiment of the present invention highlighting the internal mechanisms of the adapter with force arrows.

Referring now to FIG. 6, as drive collar 108 moves in a distal direction, the direction of arrow 110, drive pin 124 also moves in a distal direction. As a result, drive pin 124 moves up the slope of drive slot 122 towards the outer surface of compression foot 118. Because drive pin 124 cannot move radially, it forces the compression foot 118 inwards towards barrel 104 as illustrated by arrows 112 until internal surface 118*c* of compression foot 118 compresses against barrel 104.

In an embodiment, retaining slot 107*c* is slightly larger than compression feet 118 allowing chassis 107 to pull bore alignment device 500 into contact with the muzzle of barrel 104. Referring back to FIG. 6, rotation of sheath 102 in direction 114*a* and sheath 103 in the direction of 114*b* forces drive collars 108 towards distal end 107*b* of chassis 107 in accordance with directional arrow 110. Drive pins 124, through drive collars 108, force the drive slot 122 into alignment with drive pins 124. As a result, compression feet 118 are forced inwardly towards barrel 104 until internal surfaces 118*c* of compression feet 118 compress against barrel 104. Once compression feet 118 can no longer move radially due to the compression force on barrel 104, further rotation of either sheath 102, 103 in accordance with rotational arrows 114*a*, 114*b* will cause outer sheaths 102, 103 to translate in the proximal direction, opposite of the direction of travel of drive collar 108, as depicted by arrows 115. Sheath 102 will push on end cap 106, which will in turn pull chassis 107 and also attached force transfer collar 116. Ultimately, the force extends to bore alignment device 500 pulling it into contact with the muzzle of barrel 104. An embodiment includes a compressible bore seal 502, allowing the muzzle to form a seal with bore alignment device 500 when adapter 100 is tightened to barrel 104.

As best depicted in FIGS. 2 and 6, force transferring collar 116 is shaped to attach to chassis 107 at a proximal end and includes annular retention ring 116*c* at the distal end. Annular retention ring 116*c* defines receipt 116*b* in which bore alignment device 500 resides. Annular retention ring 116*c* is the structural device responsible for pulling bore alignment device 500 into contact with the muzzle of bore 104 when adapter 100 is tightened onto barrel 104.

FIG. 5 depicts three compression feet 118 surrounding barrel 104 spaced at roughly 120 degrees around the chassis 107. Any number of compression feet 118 may be used in any arrangement about the circumference of chassis 107 so long as compression feet 118 are capable of axially aligning barrel 104 with the longitudinal axis of adapter 100 when compression feet 118 compress around barrel 104.

Figure 7:
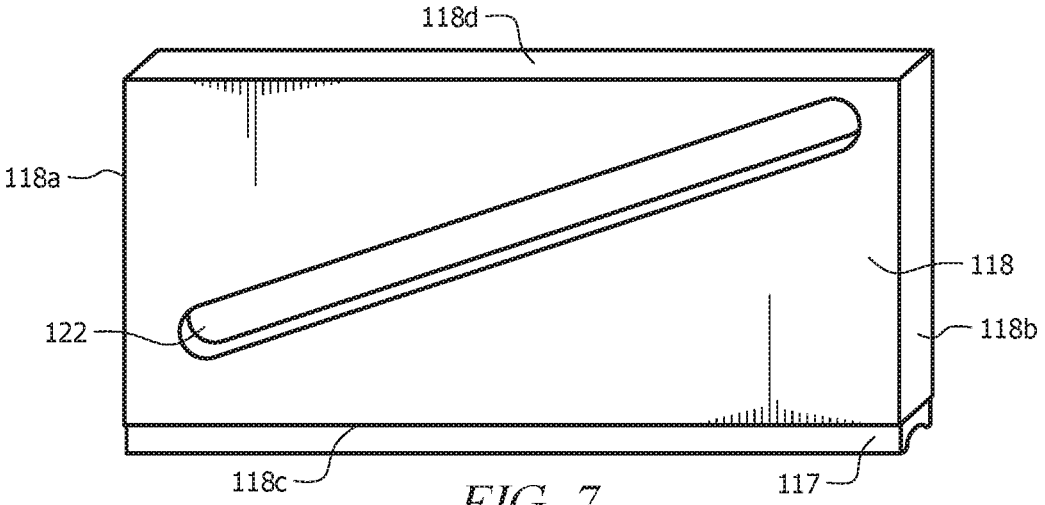
FIG. 7 is a side elevation view of an embodiment of one of the compression feet.
Figure 8:
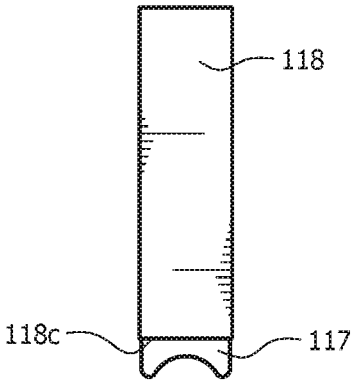
FIG. 8 is an end view of an embodiment of one of the compression feet.

As best depicted in FIGS. 7-8, each compression foot 118 may include shoes 117 secured to internal surface 118*c*. Shoes 117 are preferably curved in shape to better mate with the curved surface of barrel 104. In addition, shoes 117 are preferably comprised of a compressible material to allow for greater compression force on the barrel. Furthermore, shoes 117 are preferably made of a material that is resistant to heat in excess of 150 degrees Fahrenheit to compensate for the heating of barrel 104 when in use. Shoes 117 are also designed to prevent damage to the barrel upon contact and have a relatively high coefficient of friction to prevent the adapter 100 from becoming dislodged from barrel 104. In an embodiment, compression feet 118 may have a proximal end with a smaller total width/height than the distal end to account for tapered barrels.

Figure 9A:
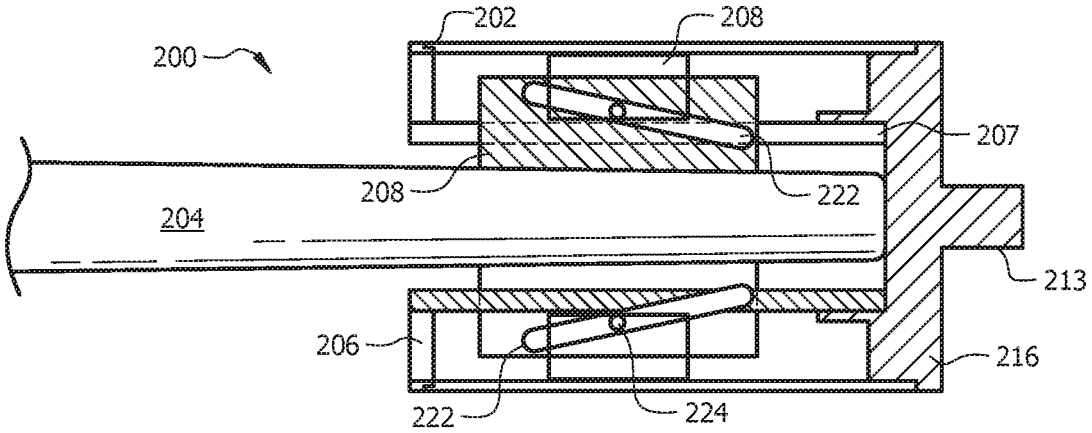
FIG. 9A is a sectional elevation view of an embodiment of the present invention.

Referring now to FIG. 9, simplified embodiment 200 has a single sheath 202, which when rotated will force a single drive collar 208 to translate in a linear direction. The simplified adapter 200 may include a simplified force transferring collar 216 as well, or may use force transferring collar 116 with bore alignment device 500. Force transferring collar 216 preferably includes an outwardly threaded suppressor attachment 213, which includes a central bore through which a bullet can pass when exiting barrel 104.

Figure 9B:
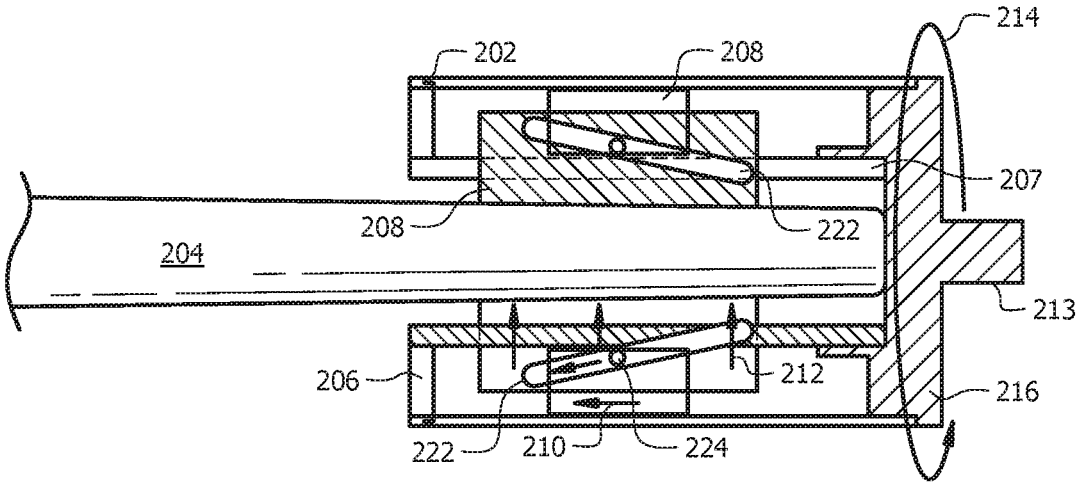
FIG. 9B is a sectional elevation view of an embodiment of the present invention highlighting the internal mechanisms of the adapter with force arrows.

FIG. 9 happen to show compression feet 218 having a drive slot 222 inversely sloped in comparison to compression feet 118. The direction of drive slots 122, 222 is not critical because the threading on internal surfaces 109, 209 can be configured such rotation of sheath 102, 202, in accordance with arrow 214, will cause drive collar 108, 208 to translate in a predetermined direction (proximal direction as depicted by arrow 210 in FIG. 9B) to force compression feet 118, 218 towards barrel 204 as illustrated by arrow 212.

Figure 10A:
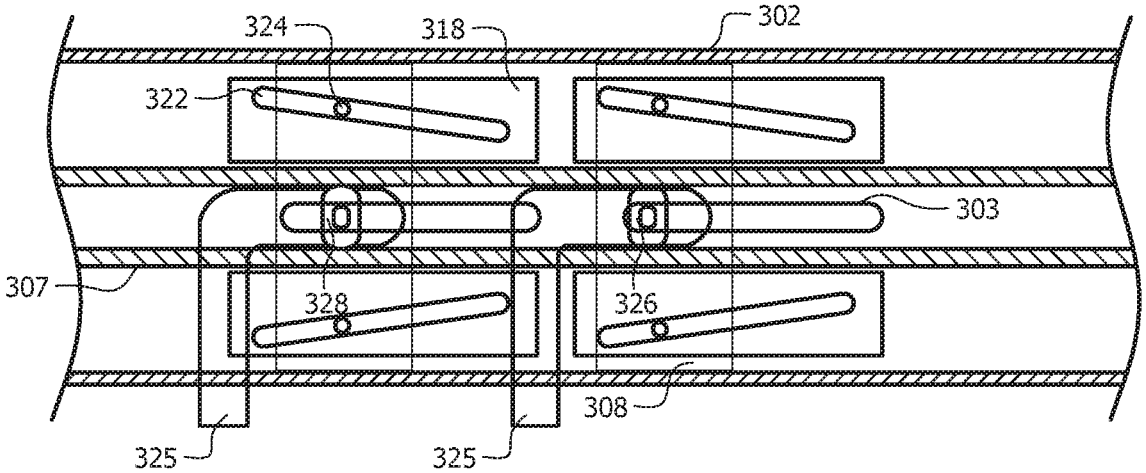
FIG. 10A is a sectional elevation view of an embodiment of the present invention.
Figure 10B:
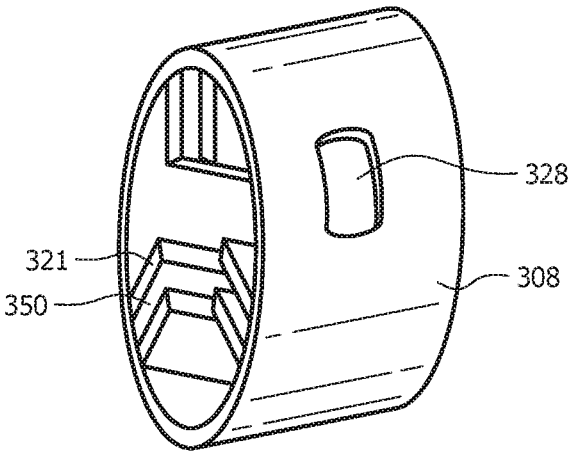
FIG. 10B is a perspective view of an embodiment of the drive collar.

Referring now to FIGS. 10-11, an embodiment generally denoted by reference numeral 300 includes non-rotational sheath 302 and a non-threaded drive collar 308. Embodiment 300 operates in generally the same manner as embodiments 100 and 200, but uses a cam lever 325 and cam slot 303 in sheath 302 to translate drive collar 308 in a linear direction. In addition, drive collar 308 includes two cam pin receipts 328 providing a mechanical interaction between drive collar 308 and cam lever 325.

As depicted in FIG. 10, drive collars 308 include feet receipts 350 established preferably by inwardly projecting structural members 321. Compression feet 318 reside within feet receipts 350 and also within retaining slot (not shown) in chassis 307. Compression feet 318 each include drive slot 322 which is responsible for altering the location of compression feet 318 as drive collars 308 translate in a linear direction.

Figure 11A:
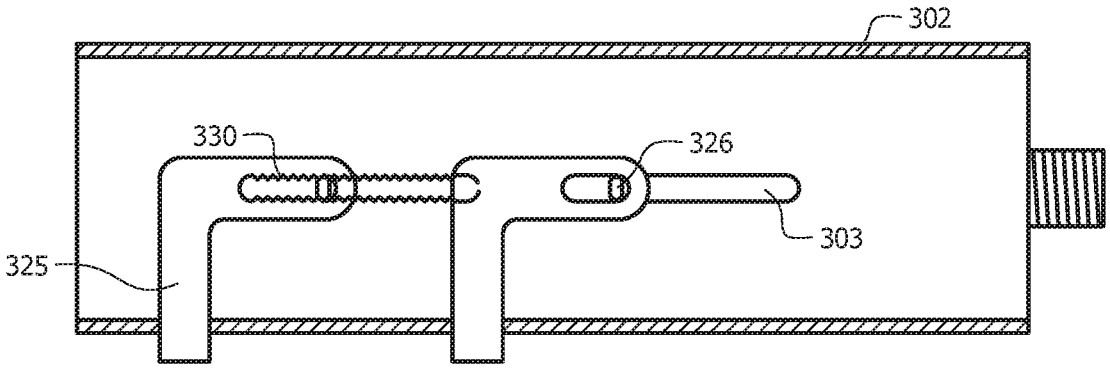
FIG. 11A is a side elevation view of an embodiment of the present invention.

Cam lever 325 has an open position and a closed/locked position. The locked position is depicted in FIGS. 10A and 11A. Cam pin 326 is irregularly shaped, or simply has a length greater than the width, and is in a fixed position with respect to cam lever 325. Opening and closing cam lever 325 thus alters the orientation of cam pin 326 between position 326*a* and 326*b*, as depicted by arrow 327 in FIG. 11C.

When in the closed position 326*a*, cam pin 326 in rotated into contact with cam slot 303 in sheath 302 thereby preventing cam lever 325 from translating along sheath 302, which in turn locks drive collar 308 and compression feet 318 at their respective positions about the length of the adapter. Because of the irregular shape, cam pin 326 can be rotated out of contact with cam slot 303 by rotating cam lever 325 to the open position 326*b*. Moreover, cam slot 303 may be smooth as depicted in FIG. 10A or may include grooves as depicted in FIG. 11A.

Figure 11B:
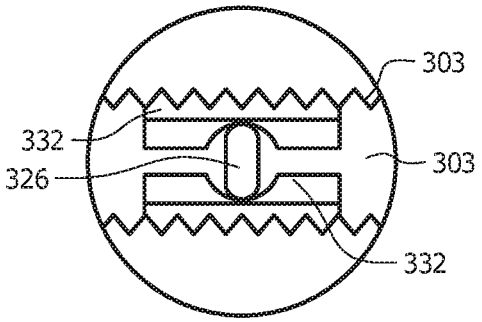
FIG. 11B is a close-up side view of an embodiment of the mechanics of the cam locks.
Figure 11C:
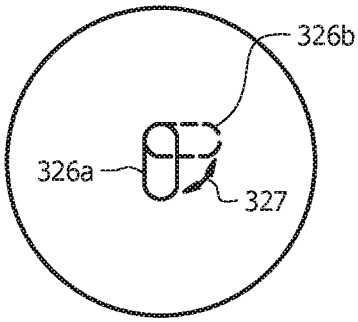
FIG. 11C is a close-up side view of an embodiment of the mechanics of the cam locks.

In an embodiment as depicted in FIG. 11B, cam pin 326 may be sandwiched between cam shrouds 332 having a plurality of grooves or teeth on an outer surface and a semicircular internal surface. Each shroud 332 is sized such that the outer grooved surface does not contact the oppositely grooved surface of cam slot 303 when cam pin 326 is rotated in open position 326*b*. Conversely, when the cam pin 326 is rotated into closed position 326*b* cam pin 326 forces shrouds 332 into contact with the grooved surface of cam slot 303. The mating of the grooved surfaces of shrouds 332 and cam slot 303 prevent cam lever 325, and in turn drive collar 308 from translating in a linear direction.

Moreover, a biasing member (not show) may be disposed between shrouds 332, or between shrouds 332 and cam slot 303, forcing the shrouds towards one another. The biasing member keeps shrouds 332 in a non-contacting positon with cam slot 303 until cam lever 325, and in turn cam pin 326, is rotated into the closed/locked position.

Figure 11D:
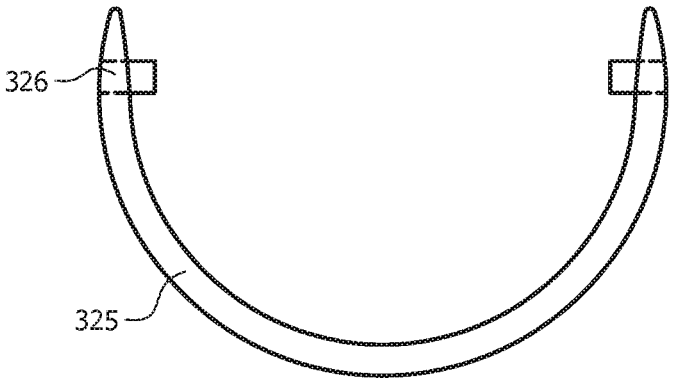
FIG. 11D is an end view of an embodiment of the cam lever.

Referring now to FIG. 11D, can lever 325 is preferably semicircular to mate with the cylindrical adapter. Alternatively, cam lever 325 can have any shape that mates with the external surface of sheath 302 or may include a shape that does not directly mate with sheath 302.

FIGS. 10-11 depict two cam levers 325 in mechanical communication with drive collars 308. The cam levers may be mechanically linked such that rotation of one cam lever causes rotation of the other cam lever, or they may be controlled independently to account for tapered barrels. In addition, an embodiment may employ a single cam lever or more than two cam levers.

Figure 12A:
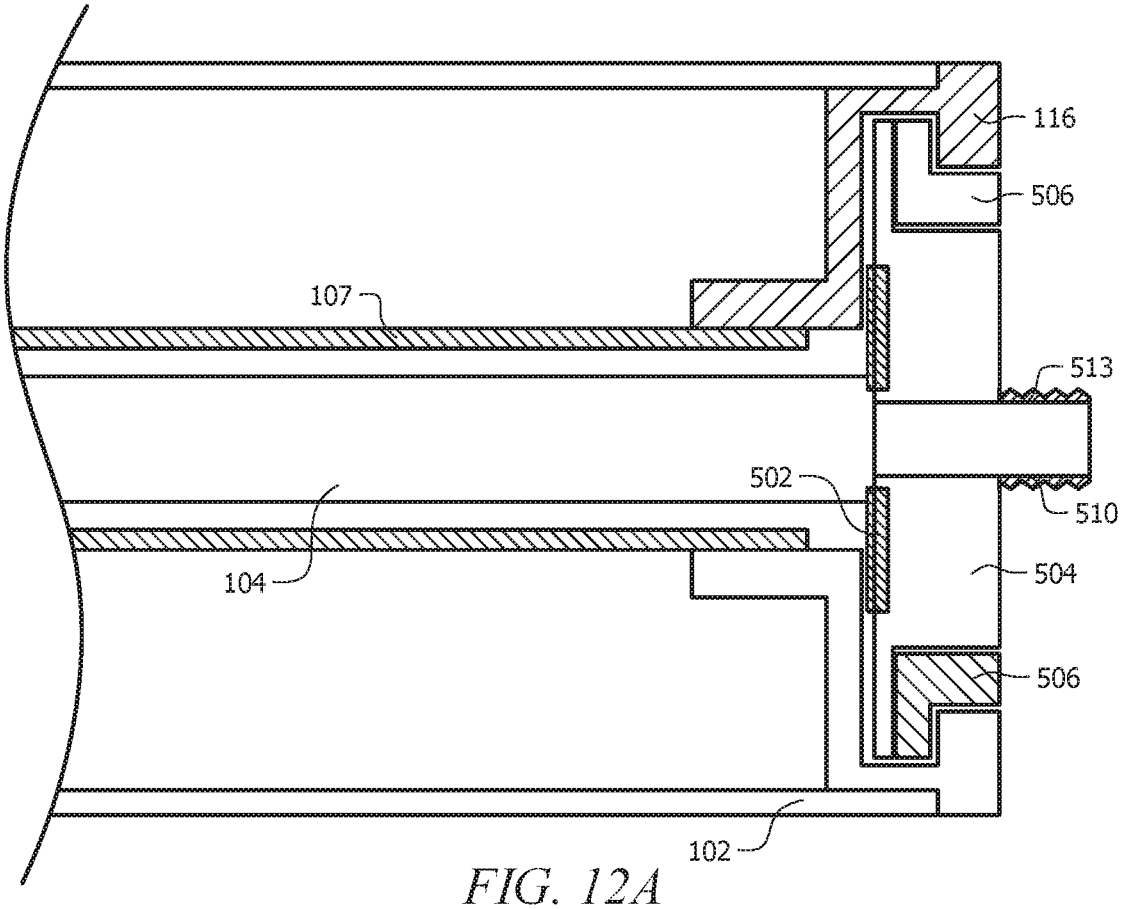
FIG. 12A is close-up section elevation view of an embodiment of the bore alignment device secured at the distal end of the adapter.
Figure 12B:
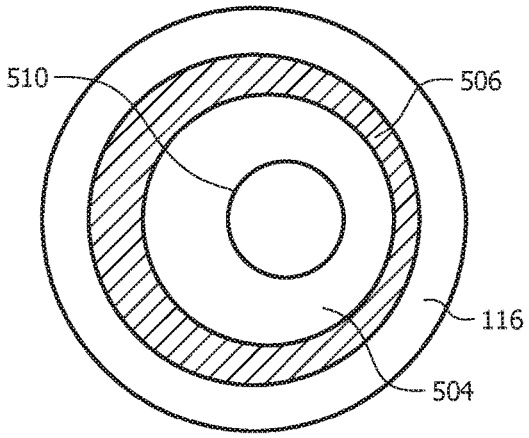
FIG. 12B is an end view of an embodiment of the bore alignment device.
Figure 12C:
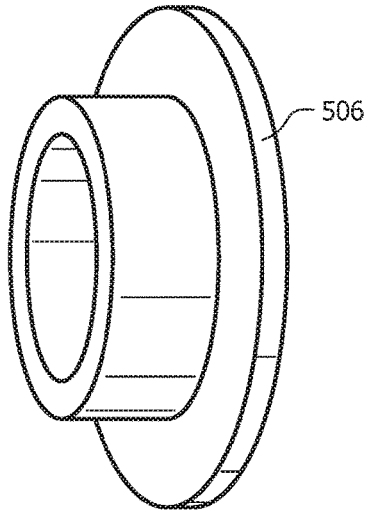
FIG. 12C is a perspective view of an embodiment of the outer ring of the bore alignment device.
Figure 12D:
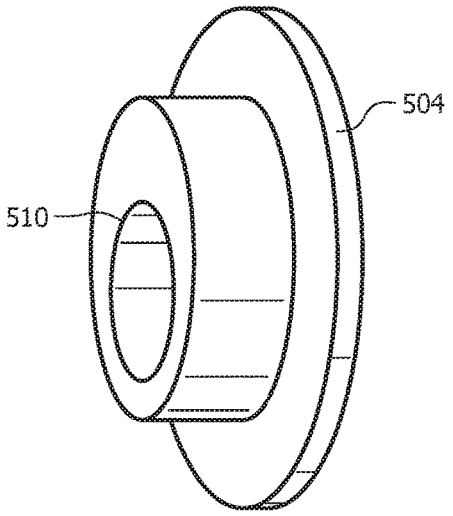
FIG. 12D is a perspective view of an embodiment of the inner ring of the bore alignment device.
Figure 12E:
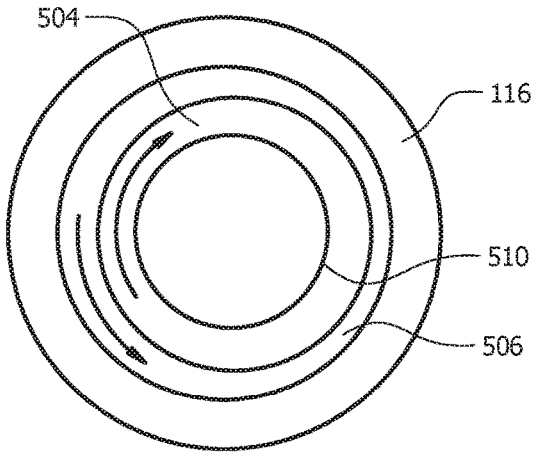
FIG. 12E is an end view of an embodiment of the bore alignment device depicting the outer and inner rings arranged such that the bore is generally centrally located.
Figure 12F:
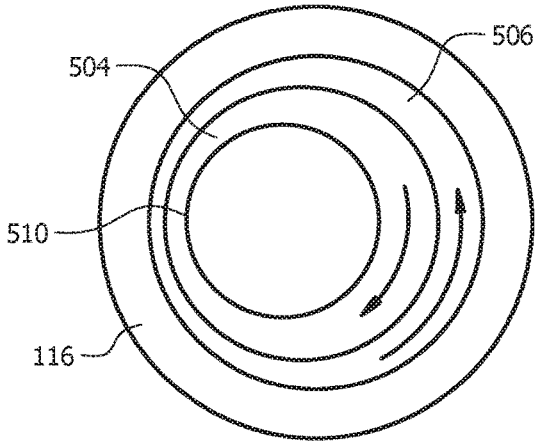
FIG. 12F is an end view of an embodiment of the bore alignment device depicting the outer and inner rings arranged such that the bore is generally offset towards a left-hand side of the adapter.
Figure 12G:
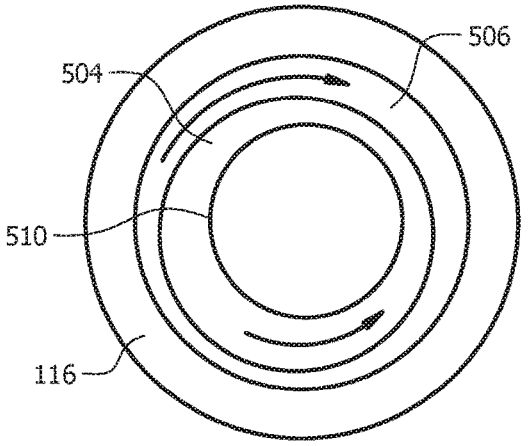
FIG. 12G is an end view of an embodiment of the bore alignment device depicting the outer and inner rings arranged such that the bore is generally offset towards an upper right hand side of the adapter.
Figure 13A:
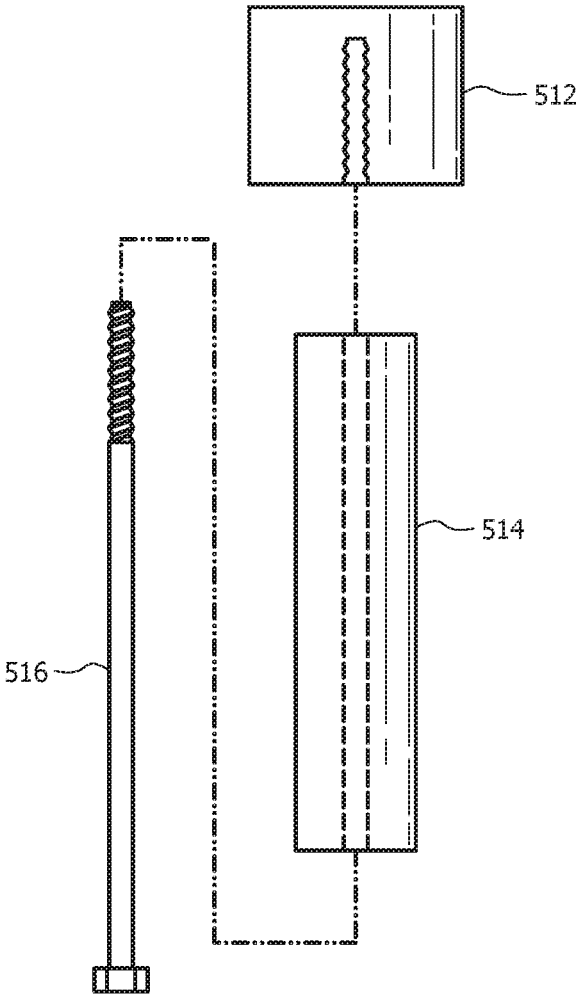
FIG. 13A is a side view of an embodiment of the bore alignment probe in a disassembled state.
Figure 13B:
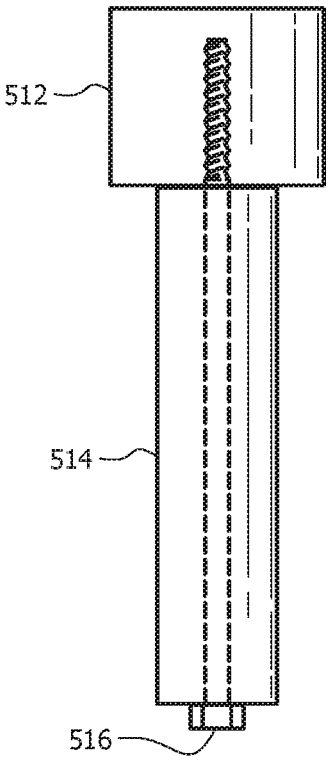
FIG. 13B is a side view of an embodiment of the bore alignment probe.

Referring now to FIGS. 12-13, an embodiment of the present invention includes bore alignment device 500 secured within receipt 116*b* defined by annular retention ring 116*c* of force transferring collar 116. Barrel guide 500 may be secured directly to one of the sheaths 102, 103 or force transferring collar 116.

Barrel guide 500 allows a user to quickly and efficiently install the adapter and align exit bore 510 with the gun barrel bore, which is not always centered about barrel 104. Barrel guide 500 includes two or more rotatable rings having offset apertures. The embodiment depicted in FIG. 12 includes inner ring 504 received by outer ring 506 in rotatable fashion. Inner ring 504 includes exit bore 510 having a center axis that can be adjusted in location with respect to the longitudinal axis of force transferring collar 116 by rotating either or both of inner ring 504 and outer ring 506 about the longitudinal axis of force transferring collar 116. As depicted in FIGS. 12E-12G, rotating inner ring 504 and outer ring 506 allows a user to relocate exit bore 510 within a nearly infinite number of positions to account for any variability with the location of the barrel bore.

Moreover, force transferring collar 116 is preferably in threaded communication with chassis 107 allowing force transferring collar 116 to be removed. Thus, bore alignment device 500 can also be removed and replaced with inner and outer rings 504, 506 having varying dimensions to account for the variability of gun calibers and their respective projectiles. Furthermore, the ability to remove bore alignment device 500 allows a user to replace inner ring 504, which includes threaded suppressor attachment 513. Thus, various inner rings having different dimensioned threaded suppressor attachments can be easily secured to the adapter to account for the variability in the attachment receipts for suppressors.

Referring to FIG. 13, bore alignment device 500 preferably includes alignment probe 511 comprised of bore nut 512 and barrel sleeve 514. Bore nut 512 is sized to fit within bore exit 510 while barrel sleeve 514 is sized to fit within barrel 104. Bore nut 512 and barrel sleeve 514 are concentrically secured to probe shaft 516 and intended to be inserted into barrel 104 and bore alignment device 500 to verify that exit bore 510 is properly aligned with the barrel bore.

Moreover, bore nut 512 and barrel sleeve 514 are temporarily secured to probe shaft 516. Bore nut 512 and barrel sleeve 514 are therefore easily replaced with varying sizes to be used with various bore alignment devices 500 and barrels 104.

After it is confirmed that bore exit 510 and the barrel bore are properly aligned, the adapter can be secured in place causing force transferring collar 116 to pull bore alignment device 500 and bore seal 502 into contact with the muzzle of barrel 104. Bore seal 502 compresses to form a tight seal and inner ring 504 and outer ring 506 are sandwiched between force transferring collar 116 and the barrel muzzle which prevents inner ring 504 and outer ring 506 from further rotation, keeping bore outlet 510 in alignment with the barrel bore. Bore probe 511 is preferably left within both bore alignment device 500 and barrel 104 until the adapter is secured in place.

Barrel guide 500 comprises of a heat resistant, preferably flexible material. The flexibility helps form a tight seal with the muzzle. Alternatively, an embodiment includes a compressible bore seal 502, allowing the muzzle to form a seal with bore alignment device 500 when adapter 100 is tightened to barrel 104.

Figure 14:
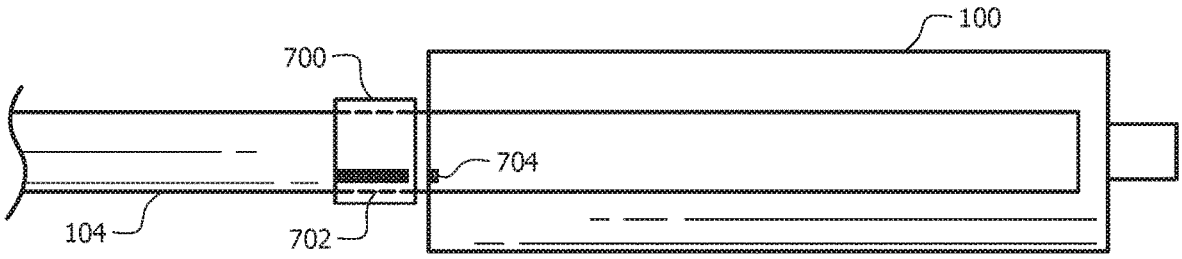
FIG. 14 is a side view of an embodiment of the adapter in conjunction with an alignment band.
Figure 15:
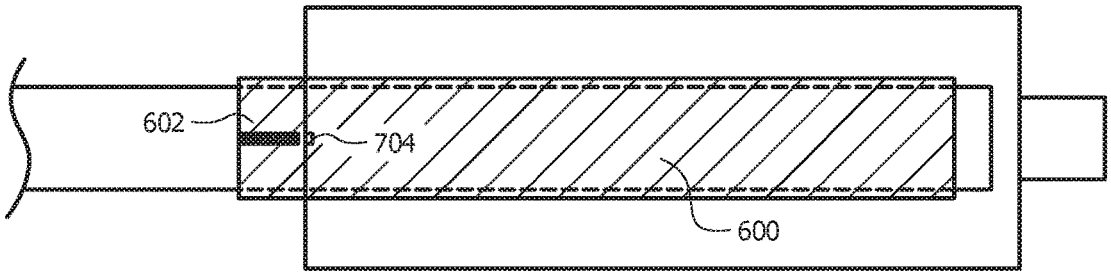
FIG. 15 is a side view of an embodiment of the adapter in conjunction with an alignment/fitment sleeve.

Referring now to FIGS. 14-15, an embodiment includes alignment indicators through alignment band 700 and/or fitment sleeve 600. As depicted in FIG. 14, alignment band 700 includes visual indicator 702 intended to axially align with an alignment indicator 704 on adapter 100. As a result, bore alignment device 500 can be precisely fit to a specific gun and then alignment band 700 can be secured to barrel 104. A user can then remove the adapter and later attach the adapter without having to go back through the step of aligning the barrel bore with bore exit 510. The user simply needs to align indicators 702 and 704.

Alternatively, fitment sleeve 600 may include visual indicator 602, which can be aligned with visual indicator 704 on the adapter and provides the same benefits. Moreover, fitment sleeve 600 provides an inexpensive and highly variable means for fitting a single size adapter to most firearms without having to modify barrel 104. Fitment sleeve 600 preferably includes self-adjusting gap (not shown) along the length of fitment sleeve 600. The gap allows fitment sleeve 600 to adjust to fit a wider range of firearm barrels.

This same process is applicable for tapered barrels through a tapered version of fitment sleeve 600. In an embodiment, the gap may widen at the rear and narrow at the front to allow perfect fitment of the adapter to barrel 104. Furthermore, fitment sleeve 600 may further provide a secure gripping surface using e.g. grooves, ridges, or slits, on an outer surface and/or inner surface of sleeve 600, for a more secure attachment of the adapter to a smooth metallic gun barrel. An embodiment of fitment sleeve 600 may be a solid flexible/compressible tubing, solid non-compressible tubing, shrink wrap, or multi-slot compressible sleeve.

Figure 16:
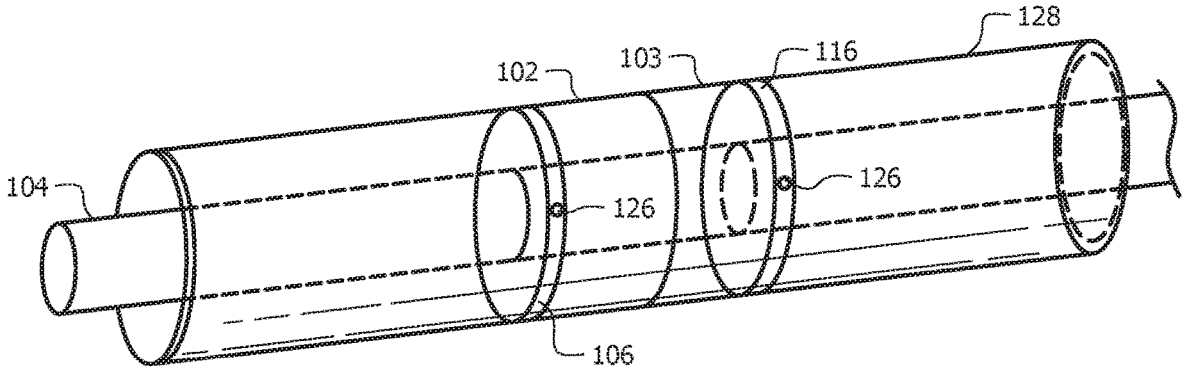
FIG. 16 is a perspective view depicting an embodiment of the adapter with a rail attachment.
Figure 17:
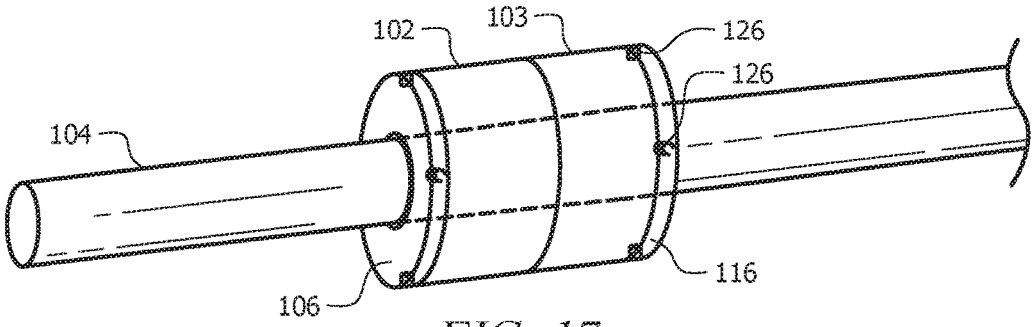
FIG. 17 is a perspective view depicting an embodiment of the adapter.
Figure 18:
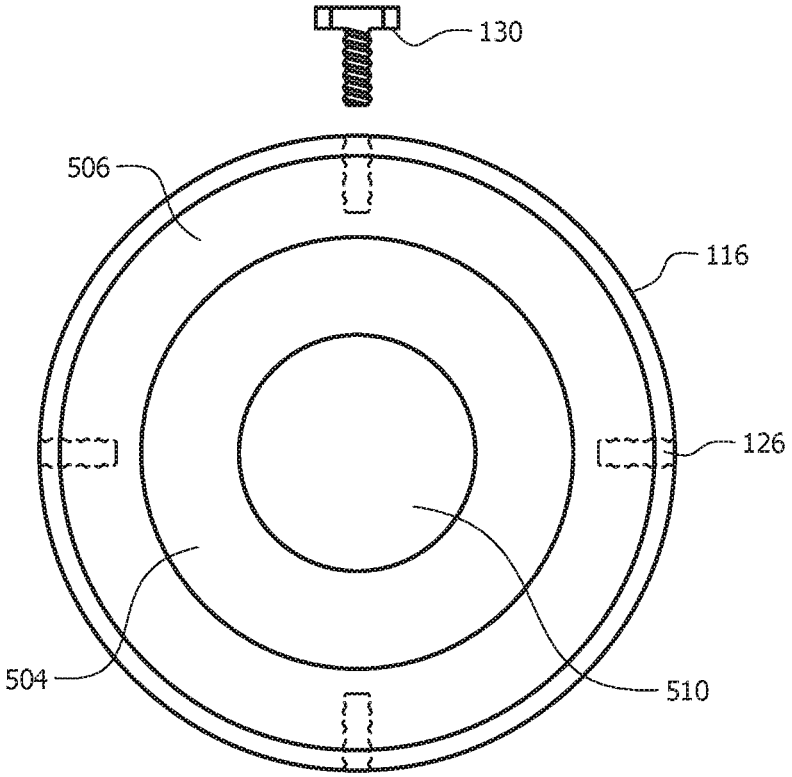
FIG. 18 is a cross-sectional view depicting an embodiment of the adapter.

Referring now to FIGS. 16-18, an embodiment includes a plurality of accessory attachment points 126 preferably disposed within end cap 106 and force transferring collar 116. In addition, or alternatively, an embodiment may include rail 128 attachable to or integrated with the adapter. There is a large market for attachment of accessories to firearms via direct attachment and attachment to a rail. The adapter of the present invention provides an easy solution for the attachment of accessories and rails without requiring a gunsmith to drill and tap barrels.

As depicted in FIGS. 16-17, rail 128 and attachment points 126 are preferably secured to a non-rotational part on the adapter—end cap 106 and force transferring collar 116—to ensure that the adapter can be tightened or loosened without the accessories getting in the way or rotating out of a preferred orientation. Moreover, as depicted in FIG. 18, attachment points 126 may be threaded holes extending into force transferring collar 116, but does so preferably in annular retention ring 116*c* to avoid threaded bolts 130 from contacting outer ring 506 of bore alignment device 500. Likewise, attachment points 126 extending into end cap 106 are preferably located in a proximal section of end cap 106 at a point where the attachment points avoid sheath 102. Furthermore, attachment points 126 may be arranged around the circumference of force transferring collar 116/end cap 106 to provide several attachment points along the circumference of the adapter.

Glossary of Claim Terms

Collar: is a structural member having an inner lumen.

Seal: is a device or substance that is used to join two things together to prevent them from coming apart or to prevent anything from passing between them.

Sheath: is an elongated tubular structure.

Sleeve: is a structural member having an inner lumen.

Tubular: means having the form or shape of a hollow, elongated body.

The advantages set forth above, and those made apparent from the foregoing description, are efficiently attained. Since certain changes may be made in the above construction without departing from the scope of the invention, it is intended that all matters contained in the foregoing description or shown in the accompanying drawings shall be interpreted as illustrative and not in a limiting sense.

It is also to be understood that the following claims are intended to cover all of the generic and specific features of the invention herein described, and all statements of the scope of the invention that, as a matter of language, might be said to fall therebetween.

What is claimed is:

1. An adapter for a firearm suppressor, comprising:

a first sheath housing a drive collar and one or more compression feet;

the drive collar including:

one or more feet receipts, each of the feet receipts adapted to receive one of the compression feet;

a drive pin secured within each of the feet receipts extending perpendicular to a longitudinal axis of the drive collar;

a bore adapted to receive a barrel of the firearm;

the one or more compression feet each including:

a first end, a second end, and a length extending therebetween and generally parallel with the longitudinal axis of the drive collar;

an outer surface, an inner surface, and a width extending therebetween;

a drive slot having a sloped orientation with respect to the length and width, such that a first end of the drive slot is proximate the first end and inner surface of the drive collar and the second end of the drive slot is proximate the second end and outer surface of the drive collar;

being generally fixed at a location along a longitudinal axis of the first sheath; and one of the drive pins in the drive collar secured within the drive slot of one of the compression feet, whereby linear translation of the drive collar parallel to the longitudinal axis of the first sheath forces the compression feet to translate in a direction perpendicular to the longitudinal axis of the first sheath.

2. The adapter of claim 1, further comprising:

the first sheath having threads on an internal surface, the threads on the first sheath interconnecting with threads on an outer surface of the drive collar;

the first sheath adapted to rotate about the longitudinal axis of the first sheath;

the drive collar rotationally fixed about the longitudinal axis of the first sheath; and whereby rotation of the first sheath about the longitudinal axis of the first sheath cause linear translation of the drive collar in a direction parallel to the longitudinal axis of the first sheath.

3. The adapter of claim 2, further comprising:

a second sheath having threads on an internal surface, the threads on the second sheath interconnecting with threads on an outer surface of a second drive collar housed within the second sheath;

the second sheath adapted to rotate about the longitudinal axis of the second sheath;

the second drive collar rotationally fixed about the longitudinal axis of the second sheath; and whereby rotation of the second sheath about the longitudinal axis of the second sheath cause linear translation of the second drive collar in a direction parallel to the longitudinal axis of the second sheath.

4. The adapter of claim 3, further comprising the threads on the first sheath having a thread direction that is opposite a thread direction of the threads on the second sheath, whereby rotation of the first sheath in a first direction and rotation of the second sheath in a second direction causes the first and second drive collars to travel in a same direction.

5. The adapter of claim 1, further comprising:

a chassis disposed within the first sheath, the chassis further comprising:

a hollow interior sized to receive the barrel of the firearm;

a longitudinal axis aligned with the longitudinal axis of the first sheath; and a plurality of slots disposed in the chassis, each slot sized to receive and house one of the compression feet.

6. The adapter of claim 5, further comprising the width of each of the compression feet being greater than the distance between the chassis and the drive collar.

7. The adapter of claim 1, further comprising a force transferring collar at a distal end of the adapter in mechanical communication with the first sheath and including an externally threaded suppressor attachment extending outwardly toward the distal end of the adapter.

8. The adapter of claim 1, further comprising a bore alignment device, the bore alignment device including:

an inner ring having an exit bore offset from a central longitudinal axis of the inner ring;

an outer ring having an inner ring receipt offset from a central longitudinal axis of the outer ring;

the inner ring receipt adapted to house at least a portion of the inner ring; and the inner and outer rings being rotatable with respect to each other such that the exit bore can be rotated into a plurality of different locations by rotating both the inner and outer rings.

9. The adapter of claim 1, further comprising:

a cam lever having cam pins extending inwardly from free ends of the cam lever, the cam pins having a length and a width with the length being greater than the width;

a pair of cam slots disposed within the first sheath with each cam slot configured to receive one of the cam pins, each cam slot having a length extending in a direction parallel to the longitudinal axis of the first sheath and a width extending in a direction perpendicular to the width;

a pair of cam pin receipts disposed in the drive collar with each cam pin receipts configured to receive one of the cam pins;

the width of each cam slot being less than the length of the cam pins; and the cam lever being rotatable with respect to the first sheath such that rotation of the cam lever to a first position allows the cam pins to travel along the length of the cam slot and rotation of the cam lever to a second position causes the cam pins to jam in the cam slot and locks the drive collar and compression feet in place.

10. The adapter of claim 1, further comprising an end cap at a proximal end of the adapter and a force transferring collar at a distal end of the collar, the end cap and the force transferring collar having threaded receipts for the attachment of accessories to the adapter.

11. The adapter of claim 1, further comprising the compression feet each having shoes on an inner surface, the shoes comprised of compressible material and being curved in shape to mate with the barrel of a firearm when the compression feet contact the barrel.

12. An adapter for a firearm suppressor, comprising:

a first sheath having a longitudinal axis and housing a chassis, a drive collar and one or more compression feet;

the chassis further comprising:

a hollow interior sized to receive a barrel of the firearm;

a longitudinal axis aligned with the longitudinal axis of the first sheath; and one or more slots disposed in the chassis, each slot sized to receive and house one of the compression feet;

the drive collar including:

one or more feet receipts, each of the feet receipts adapted to receive one of the compression feet;

a drive pin secured within each of the feet receipts extending perpendicular to a longitudinal axis of the drive collar;

a bore adapted to receive the barrel of the firearm;

the one or more compression feet each including:

a first end, a second end, and a length extending therebetween and generally aligned with the longitudinal axis of the drive collar;

an outer surface, an inner surface, and a width extending therebetween, the width being greater than the distance between the chassis and the drive collar resulting in each of the compression feet residing within one of the plurality of slots in the chassis;

a drive slot having a sloped orientation with respect to the length and width, such that a first end of the drive slot is proximate the first end and inner surface of the drive collar and the second end of the drive slot is proximate the second end and outer surface of the drive collar;

the one or more slots in the chassis preventing the compression feet from substantially moving in a linear direction along the longitudinal axis of the first sheath; and whereby linear translation of the drive collar about the longitudinal axis of the first sheath forces the compression feet to translate towards the longitudinal axis of the first sheath.

13. The adapter of claim 12, further comprising:

the first sheath having threads on an internal surface, the threads on the first sheath interconnecting with threads on an outer surface of the drive collar;

the first sheath adapted to rotate about the longitudinal axis of the first sheath;

the drive collar rotationally fixed about the longitudinal axis of the first sheath; and whereby rotation of the first sheath about the longitudinal axis of the first sheath cause linear translation of the drive collar in a direction parallel to the longitudinal axis of the first sheath.

14. The adapter of claim 13, further comprising:

a second sheath having threads on an internal surface, the threads on the second sheath interconnecting with threads on an outer surface of a second drive collar housed within the second sheath;

the second sheath adapted to rotate about the longitudinal axis of the second sheath;

the second drive collar rotationally fixed about the longitudinal axis of the second sheath; and whereby rotation of the second sheath about the longitudinal axis of the second sheath cause linear translation of the second drive collar in a direction parallel to the longitudinal axis of the second sheath.

15. The adapter of claim 14, further comprising the threads on the first sheath having a thread direction that is opposite a thread direction of the threads on the second sheath, whereby rotation of the first sheath in a first direction and rotation of the second sheath in a second direction causes the first and second drive collars to travel in a same direction.

16. The adapter of claim 12, further comprising a force transferring collar at a distal end of the adapter in mechanical communication with the first sheath and including an externally threaded suppressor attachment extending outwardly toward the distal end of the adapter.

17. The adapter of claim 12, further comprising a bore alignment device, the bore alignment device including:

an inner ring having an exit bore offset from a central longitudinal axis of the inner ring;

an outer ring having an inner ring receipt offset from a central longitudinal axis of the outer ring;

the inner ring receipt adapted to house at least a portion of the inner ring; and the inner and outer rings being rotatable with respect to each other such that the exit bore can be rotated into a plurality of different locations by rotating both the inner and outer rings.

18. The adapter of claim 12, further comprising:

a cam lever having cam pins extending inwardly from fee ends of the cam lever, the cam pins having a length and a width with the length being greater than the width;

a pair of cam slots disposed within the first sheath with each cam slot configured to receive one of the cam pins, each cam slot having a length extending in a direction parallel to the longitudinal axis of the first sheath and a width extending in a direction perpendicular to the width;

a pair of cam pin receipts disposed in the drive collar with each cam pin receipts configured to receive one of the cam pins;

the width of each cam slot being less than the length of the cam pins; and the cam lever being rotatable with respect to the first sheath such that rotation of the cam lever to a first position allows the cam pins to travel along the length of the cam slot and rotation of the cam lever to a second position causes the cam pins to jam in the cam slot and locks the drive collar and compression feet in place.

19. The adapter of claim 12, further comprising an end cap at a proximal end of the adapter and a force transferring collar at a distal end of the collar, the end cap and the force transferring collar having threaded receipts for the attachment of accessories to the adapter.

20. The adapter of claim 12, further comprising the compression feet each having shoes on an inner surface, the shoes comprised of compressible material and being curved in shape to mate with the barrel of a firearm when the compression feet contact the barrel.

* * * * *